United States Patent [19]

Akashi

[11] 4,244,087

[45] Jan. 13, 1981

[54] SEPARABLE SLIDE FASTENER

[75] Inventor: Shunji Akashi, Kurobe, Japan

[73] Assignee: Yoshida Kogyo K.K., Tokyo, Japan

[21] Appl. No.: 28,068

[22] Filed: Apr. 9, 1979

[30] Foreign Application Priority Data

Apr. 19, 1978 [JP] Japan ..... 53-52232[U]

[51] Int. Cl.[3] ..... A44B 19/38

[52] U.S. Cl. ..... 24/205.11 R; 24/205.11 F

[58] Field of Search ..... 24/205.11 R, 205.11 F

[56] References Cited

U.S. PATENT DOCUMENTS

| | | | |
|---|---|---|---|
| 3,618,178 | 11/1971 | Hansen | 24/205.11 F |
| 3,663,996 | 5/1972 | Heimberger | 24/205.11 F |

FOREIGN PATENT DOCUMENTS

| | | | |
|---|---|---|---|
| 276200 | 10/1965 | Australia | 24/205.11 F |
| 1440009 | 4/1966 | France | 24/205.11 F |
| 197561 | 5/1938 | Switzerland | 24/205.11 R |
| 548156 | 9/1942 | United Kingdom | 24/205.11 R |
| 675881 | 7/1952 | United Kingdom | 24/205.11 R |

*Primary Examiner*—Roy D. Frazier
*Assistant Examiner*—Peter A. Aschenbrenner
*Attorney, Agent, or Firm*—Bucknam and Archer

[57] ABSTRACT

A separable slide fastener is disclosed which is provided with a separable end stop assembly comprising a pin member on one stringer and a socket member on the other stringer, both members being releasably interengageable to couple the stringers, and retaining means integral with said pin member retaining the latter in locked relation to said socket member during a starting movement of a slider.

6 Claims, 7 Drawing Figures

SEPARABLE SLIDE FASTENER

BACKGROUND OF THE INVENTION

1. Field of the Invention

This invention relates to a slide fastener and more particularly to a separable type of slide fastener having a separable end stop assembly.

2. Prior Art

There are known a number of separable slide fasteners equipped with a separator assembly which comprises a socket member mounted on one of two companion stringers and a pin member mounted on the other stringer, the pin and socket members being releasably interengageable to couple the two stringers. When thus coupling the stringers, a slider functioning to close and open the fastener is brought against the socket member, and then the pin member is inserted through a channel in the slider into the socket member. The slider is thereafter moved along the confronting edges of the stringers to progressively take the fastener into closed disposition. Difficulty has been experienced in such instance with the prior art devices in retaining the pin member against displacement with respect to the associated socket; that is to say, the pin member would often move with the slider with the results that "mismeshing" would occur in opposed rows of coupling elements on the fastener. Prolonged use of the fastener in such condition would invite wear of the terminal or lowermost ones of the elements and eventually disengagement or "rupture" of the rows of coupling elements.

SUMMARY OF THE INVENTION

It is therefore an object of the present invention to provide an improved separable slide fastener which will eliminate the above-noted difficulties of the prior art devices.

A more specific object of the invention is to provide a separable slide fastener having means of retaining a pin member against displacement with respect to its associated socket member during a closing mode of operation of the fastener.

Briefly stated, a separable slide fastener according to the invention is provided with a separable end stop assembly which comprises a pin member on one stringer and a socket member on the other stringer, said socket member having an opening dimensioned to collaterally receive said pin member and a longitudinal slit communicating with said opening and defined between a flanged portion and a bottom wall of said socket member, said pin member having a pin retainer land integrally formed therewith and having a sloping surface tilted such that said land has a thick region adjacent said pin member engageable with either of said flanged porton and said bottom wall of said socket member and a thin region disposed remote from said pin member for unobstructive passage of the flanged opening of the slider.

DETAILED DESCRIPTION OF THE PREFERRED EMBODIMENTS

Figure 1:
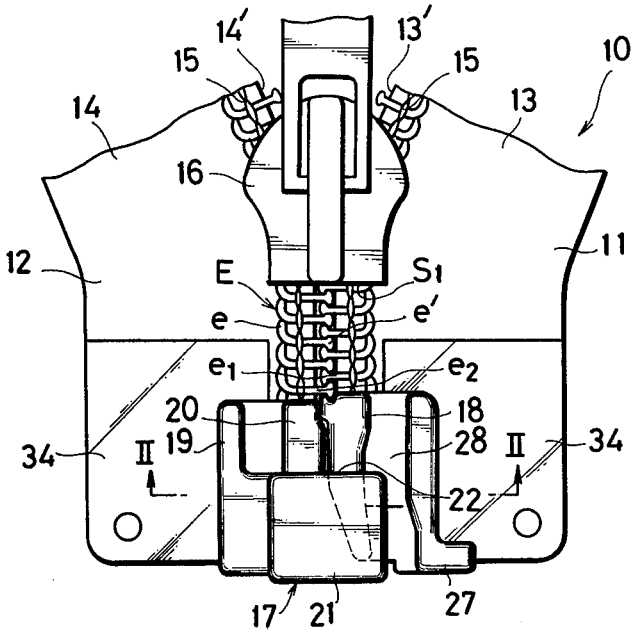
FIG. 1 is a fragmentary plan view of a separable slide fastener provided in accordance with the invention.

Referring now to the drawings and FIG. 1 in particular, there is shown a separable slide fastener 10 which comprises a pair of companion stringers 11,12 having oppositely disposed fabric tapes 13,14 and rows of interlocking fastener elements E mounted on the confronting longitudinal beaded edges 13',14' of the respective tapes 13,14. The fastener elements E are shown for purposes of illustration to be in the form of a continuous helical coil having a succession of convolutions e each with a coupling head portion e' and are sewn as at 15 to the edge of the respective tape. The two companion stringers 11,12 are taken into and out of meshing or interlocking engagement with each other by the manipulation of a slider 16 in the well known manner.

The stringers 11 and 12 are held together at their one ends by means of a separable end stop assembly generally designated 17. The stop assembly 17 is shown for purposes of illustration as applied to the lower ends of the stringers 11,12, and hance serves as a bottom end stop.

The separable end stop assembly 17 comprises a pin member 18 mounted on one stringer 11 and a socket member 19 mounted on the other stringer 12, the pin and socket members being releasably interengageable to couple the companion stringers 11,12, in a manner hereinafter described.

Figure 5:
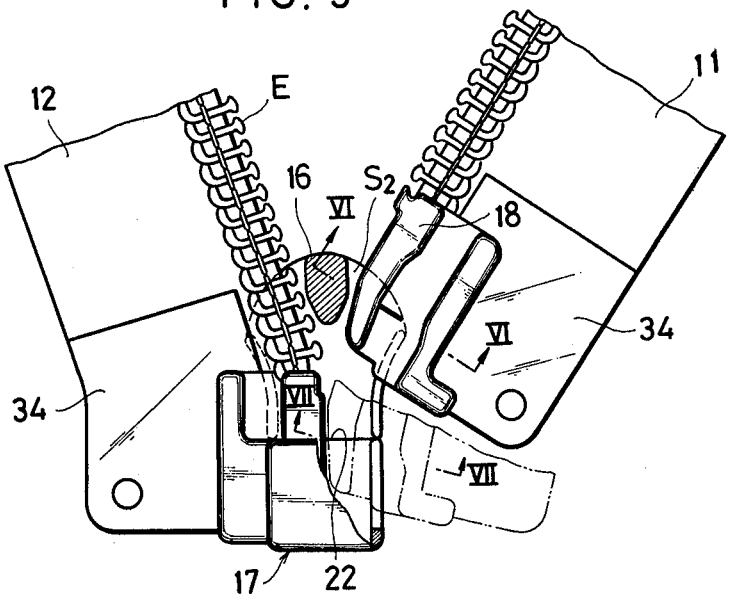
FIG. 5 is a fragmentary plan view of the separable slide fastener utilized to explain the initial mode of coupling of the two companion stringers.

The socket member 19 has a stud portion 20 extending from below the terminal end convolution e2 of interlocking element row E to the region of the lower edge of its companion stringer 12. Formed integrally with the stud portion 20 is a socket portion 21 having an abutment 22 extending transversely beyond the beaded edge 14' of stringer 12 and coextensive with the rear end $S_1$, of the slider S such that the latter may be borne against the abutment 22 in the assembled relation of the pin and socket members 18,19 when inserting the pin 18 into the socket 19 as shown in FIG. 5. The socket portion 21 is provided with an opening 23 dimensioned to collaterally receive the pin member 18. Communicating with the opening 23 is a longitudinal slit 24 defined between a flanged portion 25 and a bottom wall 26 of the socket portion 21.

The pin member 18 extends longitudinally along its companion beaded edge 13' from below the end convolution e1 to the region of the lower edge of its companion stringer 11. Disposed oppositely to and parallel with the pin member 18 is an L-shaped reinforcing and gripping portion 27 which is of substantially the same width as the pin 18 and which serves to reinforce the end portion of the tape 13 and also to allow finger-gripping when inserting the pin 18 into the socket 19. The pin 18 and the gripping portion 27 are interconnected by a pin retainer land 28 having a sloping surface 29 raised above a flat surface 30, the two surfaces being demarcated transversely by a partition portion 31 as shown in FIG.

Figure 4:
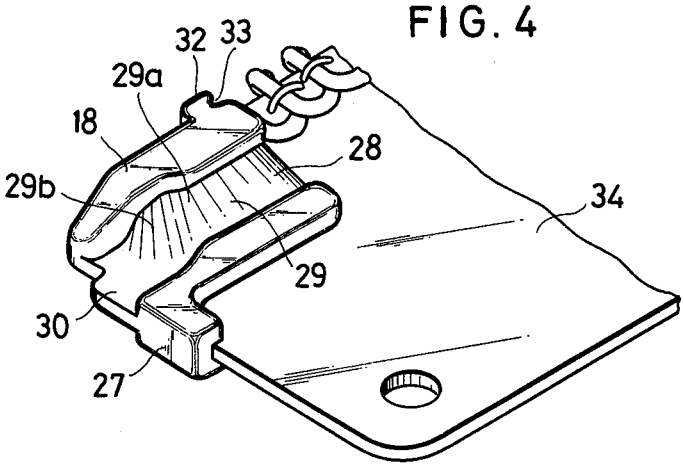
FIG. 4 is a view similar to FIG. 3 but showing another preferred form of pin member according to the invention.

3, or being merged together contiguously as shown in FIG. 4. The raised sloping surface 29 is tilted downwardly toward the gripping portion 27 so that the land 28 has a thick region 29*a* adjacent the pin 18 and a thin region 29*b* remote from the pin 18 or adjacent the gripping portion 27.

The pin member 18 has a bump 32 projecting transversely slightly beyond the beaded edge 13', the bump 32 having a recess 33 dimensioned to receive the coupling head e' of the end convolution e2 on stringer 12 in the assembled relation of pin 18 and socket 19.

It will be noted that the separable end stop assembly 17 is preferably made of a plastic material such that all the portions discussed of the assembly 17 can be conveniently moulded into the respective desired shapes and fused integrally with the fabric of the stringer tapes. Designated at 34 is a reinforcing strip of film attached to the bottom portion of the respective tape 13,(14) over an upper surface thereof, and over which the separable stop assembly 17 are laid.

Figure 2:
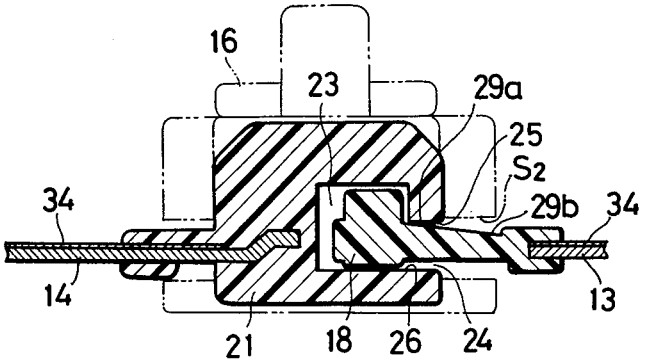
FIG. 2 is an enlarged cross-sectional view taken on the line II—II of FIG. 1.
Figure 3:
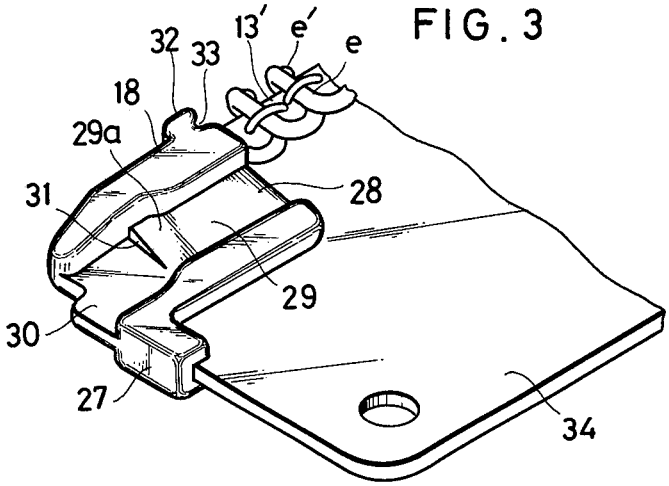
FIG. 3 is a fragmentary perspective view of one of the two companion stringers having a preferred form of pin member according to the invention.
Figure 6:
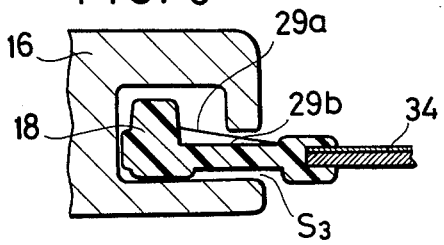
FIG. 6 is an enlarged cross-sectional view taken on the line VI—VI of FIG. 5.
Figure 7:
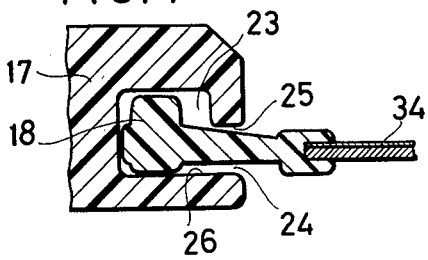
FIG. 7 is an enlarged cross-sectional view taken on the line VII—VII of FIG. 5

With this construction of the separable slide fastener according to the invention, the operation thereof takes place in the manner illustrated in FIG. 5 in which the bottom ends of the respective stringers 11,12 are being brought into coupling engagement with each other. The pin 18 is inserted into a channel $S_2$ of the slider 16, which has been held in abutted relation to the socket member 19, and thence into the opening 23 of the socket member 19. This insertion of the pin 18 is conveniently done by finger-gripping the integral L-shaped reinforcing portion 27. The pin member 18 advances unobstructedly with respect to the slider 16 because the retainer land 28 is reduced in thickness as at 29*b* where it registers with the region of flanged opening $S_3$ of the slider as shown in FIG. 2 and more specifically in FIG. 6. The pin member 18 further advances into the opening 23 of the socket member 19 as indicated by dotted-chain line in FIG. 5 or as shown in FIG. 7 and finally comes into fully assembled engagement with the socket member 19 as shown in FIGS. 1 and 2, in which the pin member 18 is firmly retained in place with respect to the socket member 19 because the integral retainer land 28 is thickened as at 29*a* where it registers with the slit 24 of the socket member 19 and hence is brought into braked engagement with the flanged portion 25 of the member 19. In this position, the bump 32 on the pin 18 is held in hooked relation to the coupling head e' of the end convolution e2 on socket-mounted stringer 12.

In such fully assembled relation of the pin and socket member 18,19, the slider 16 may be started in a direction to close the two companion stringers 11,12 as shown in FIG. 1 without inviting concomitant movement of the pin member 18 which has been locked with respect to its associated socket member 19, thus ensuring proper meshing of the fastener progressive elements E.

While the invention has been shown and described in its preferred form, changes may be made in the structure disclosed without departing from the scope of the appended claims. As for an example of such changes, arrangements may be made such that the retainer land 28 is engageable with either or both of the flanged portion 25 and bottom wall 26 of the socket member 19.

What is claimed is:

1. A slide fastener comprising: a pair of companion stringers each having a fabric tape and a row of interlocking fastener elements mounted on a longitudinal edge of said tape; a slider having a flanged opening for taking said companion stringers into and out of engagement; and a separable end stop assembly including a pin member on one of said companion stringers and a socket member on the other stringer, said socket member having an opening for collaterally receiving said pin member, and a longitudinal slit communicating with said opening and defined by a flanged portion and a bottom wall of said socket member, said pin member including a pin retainer land integrally formed therewith, said land having an inclined surface sloping downward from said pin member toward an outer longitudinal edge of said one of the companion stringers so that said land has a thick region adjacent said pin member and a thin region remote from said pin member, said thick region of said land having such thickness that said land is engageable with either of said flanged portion and said bottom wall of said socket member when said pin member is inserted into said opening of said socket member to thereby secure said pin and socket members together in a predetermined relation, and said thin region of said land having such thickness that said flanged opening of said slider can pass thereover without being obstructed by said land.

2. A separable slide fastener according to claim 1, said land further having a flat surface disposed adjacent an end of said one of the companion stringers, said inclined surface being disposed remote from said end of said one companion stringer.

3. A separable slide fastener according to claim 2, said flat and inclined surfaces being separated by a vertical parting portion extending transversely of said one companion stringer.

4. A separable slide fastener according to claim 2, said inclined surface adjoining said flat surface through the medium of a downwardly sloping surface.

5. A separable slide fastener according to claim 1, said pin member further including an L-shaped reinforcing portion interconnected thereto by said retainer land, said reinforcing portion being disposed adjacent said thin region of said retainer land.

6. In a slide fastener having a pair of cooperating stringers each having a row of interlockable fastener elements mounted on a longitudinal edge of the stringer; a slider moveable along said stringers to bring said fastener elements into and out of interlocking engagement; and a separble end stop assembly including a pin member on one stringer and a socket member on the other stringer disposed to receive said pin member to secure the stringers together at the end stop assembly, the improvement which comprises means on said socket member defining a longitudinal slit; a tapered land portion on said pin member, said land portion extending through said slit of the socket member and laterally toward said one stringer when said pin member is received by the socket member, said land portion having a tapered thickness to establish braking engagement with said slit defining means to thereby secure said pin and socket members together in a predetermined relation; and a projection on said pin member disposed for hooking engagement with a fastener element on said other stringer when said pin and socket members are secured together.

* * * * *